US008418860B2

(12) United States Patent
Rimmer et al.

(10) Patent No.: US 8,418,860 B2
(45) Date of Patent: Apr. 16, 2013

(54) DIVE GEAR STAND

(75) Inventors: Nigel Geoffrey Rimmer, Scarborough (AU); Daniel James Pryce, Redcliffe (AU); Edward Joseph Khoury, Bateman (AU)

(73) Assignees: Nigel Geoffrey Rimmer, Scarborough, Western Australia (AU); Daniel James Pryce, Redcliffe, Western Australia (AU)

( * ) Notice: Subject to any disclaimer, the term of this patent is extended or adjusted under 35 U.S.C. 154(b) by 0 days.

(21) Appl. No.: 13/553,367

(22) Filed: Jul. 19, 2012

(65) Prior Publication Data

US 2012/0279936 A1 Nov. 8, 2012

Related U.S. Application Data

(63) Continuation of application No. PCT/AU2011/000036, filed on Jan. 14, 2011.

(30) Foreign Application Priority Data

Jan. 19, 2010 (AU) ..... 2010900181
Oct. 15, 2010 (AU) ..... 2010904609

(51) Int. Cl.
*A47F 7/00* (2006.01)

(52) U.S. Cl.
USPC ..... 211/85.7; 211/85.3; 211/196

(58) Field of Classification Search ..... 211/85.7, 211/85.3, 195–197, 85, 205; 248/125.8, 248/166, 434, 435, 170, 171
See application file for complete search history.

(56) References Cited

U.S. PATENT DOCUMENTS 420,838 A * 2/1890 Stauffer ..... 211/165
459,583 A * 9/1891 Johnson ..... 248/340
904,319 A * 11/1908 Duncan ..... 211/166
1,075,395 A * 10/1913 Beegle ..... 211/196

(Continued)

FOREIGN PATENT DOCUMENTS

CA 2512691 A1 1/2007
EP 1783265 A1 5/2005

(Continued)

OTHER PUBLICATIONS

International Search Report for correspondent Application No. PCT/AU2011/000036, mailed on Feb. 25, 2011 (3 pages).

(Continued)

*Primary Examiner* — Korie H. Chan
(74) *Attorney, Agent, or Firm* — Patentbar International, P.C.

(57) ABSTRACT

A dive gear stand (10) comprising a frame (12) including a main shaft (16) supported vertically from a plurality of legs (18). A first set (30) of arm members (14) is pivotally connected relative to the frame (12) and arm supports (32) are pivotally connected to distal ends of the arm members (14). The arm members (14) are pivotable between a first position parallel to the main shaft (16) and a second position extending outwardly from the main shaft (16). Each of the arm supports (32) is pivotable between a first position in which it is parallel and adjacent the associated arm member (14) and a second position in which it extends at an angle to the associated arm member (14) such that a second end thereof engages with the frame (12) to support the arm member (14) in the second position.

17 Claims, 9 Drawing Sheets

U.S. PATENT DOCUMENTS

| | | | | | |
|---|---|---|---|---|---|
| 1,525,701 | A | * | 2/1925 | Rose et al. | 211/196 |
| 1,883,435 | A | * | 10/1932 | Zifferer et al. | 211/165 |
| 2,335,030 | A | * | 11/1943 | Rotheraine | 211/85.3 |
| 3,302,800 | A | * | 2/1967 | Zdanowski | 211/123 |
| 3,324,928 | A | * | 6/1967 | Muller | 160/24 |
| 3,642,145 | A | * | 2/1972 | Shelton | 211/78 |
| 4,550,840 | A | * | 11/1985 | Van Deursen | 211/197 |
| 5,022,617 | A | * | 6/1991 | Henderson | 248/125.8 |
| D339,249 | S | * | 9/1993 | Wu | D6/411 |
| 5,509,629 | A | * | 4/1996 | Sassmannshausen et al. | 248/171 |
| 5,819,961 | A | * | 10/1998 | Harris | 211/196 |
| 7,284,447 | B2 | | 10/2007 | Scarborough | |
| 7,530,543 | B1 | * | 5/2009 | Kremzar | 248/441.1 |
| D643,648 | S | * | 8/2011 | Eason | D6/466 |
| D665,190 | S | * | 8/2012 | Fitzpatrick | D6/415 |

FOREIGN PATENT DOCUMENTS

| | | | |
|---|---|---|---|
| GB | 2434974 | A | 8/2007 |
| JP | 2001-009199 | A | 1/2001 |
| JP | 2006-192205 | A | 7/2006 |
| KR | 20-2011-0003159 | U | 3/2011 |

OTHER PUBLICATIONS

International Preliminary Report on Patentability for correspondent Application No. PCT/AU2011/000036, dated Mar. 5, 2012 (11 pages).

* cited by examiner

DIVE GEAR STAND

RELATED APPLICATIONS

This application is a continuation of PCT application Ser. No. PCT/AU2011/000036 filed on Jan. 14, 2011 which claims priority to Australian Patent Application Nos. 2010900181, filed Jan. 19, 2010, and 2010904609, filed Oct. 15, 2010, all of which are incorporated herein by reference in their entirety.

FIELD OF THE INVENTION

The present invention relates to a stand to be used for hanging equipment used by divers.

BACKGROUND OF THE INVENTION

Divers commonly have a range of equipment that must be taken with them to the dive location. After returning from a dive, it is preferable for the gear to be spread out to allow it to dry. When diving from a beach, it is desirable to support the drying gear off the ground to allow it to dry without getting coated in sand.

The present invention relates to a portable dive gear stand for use in situations such as the beach in order to allow the gear to be easily supported for drying.

SUMMARY OF THE INVENTION

According to one aspect of the present invention there is provided a dive gear stand comprising:

a frame including a main shaft supported vertically from a plurality of legs;

a first set of arm members each pivotally connected at a first end thereof relative to the frame; and a set of arm supports each pivotally connected at a first end thereof to a second end of an associated arm member of the first set;

wherein each of the arm members of the first set is pivotable between a first position in which the arm member is oriented parallel to the main shaft and a second position in which the arm member extends outwardly from the main shaft and wherein each of the arm supports is pivotable between a first position in which it is parallel and adjacent the associated arm member and a second position in which it extends at an angle to the associated arm member such that a second end thereof is releasably engageable with the frame at a location above the first ends of the arm members to support the arm member in the second position.

Preferably the arm members extend upwardly and away from the main shaft in the second positions.

Preferably the legs are pivotally connected to the main shaft at first ends thereof such that the legs can be pivoted between a first position in which the legs are oriented parallel to the main shaft and a second position in which the legs extend at an angle outwardly from the main shaft.

In a preferred embodiment, first ends of the arm members of the first set and first ends of the legs are pivotally connected to a first collar slidably mounted on the main shaft.

Preferably each of the arm members of the first set is pivotable to a position in which it is parallel and adjacent one of the legs.

Struts are preferably connected from a lower end of the main shaft to a location on each of the legs between the first and second ends such that sliding motion of the main shaft up through the first collar causes the legs to move inwardly towards each other.

In a preferred embodiment, each of the arm members of the first set is provided with a plurality of notches along an upper edge thereof, each notch being provided to receive tubing of diving gear.

Preferably each of the notches comprises an inner portion being generally circular in shape to receive the tubing and a narrowed neck portion adjacent the first edge of the arm member.

In one embodiment, each of the arm supports comprises a pair of parallel elongate members joined at ends thereof by an interconnecting portion such that when an arm support pivots to the first position thereof, a portion of the arm member is received between the pair of elongate members.

A second collar may be provided on the main shaft, the second collar having hooks thereon with upwardly facing openings into which the interconnecting portions of the arm supports are received.

In one embodiment, the first set of arm members comprises three arm members at equal angular spacings around the main shaft and three legs are provided each adjacent one of the arm members.

Preferably each of the arm members of the first set is provided with an arm extension, each arm extension being pivotally connected to the second end of the arm member such that the arm extension is pivotable between an extended position in which the arm extension extends generally away from the second end of the arm member to a collapsed position in which the arm extension is folded back against the arm member.

The main shaft preferably comprises a lower portion, a central portion and an upper portion wherein the central portion is received for sliding motion within the lower portion and the upper portion is received for sliding motion within the central portion.

In a preferred embodiment, there is provided a second set of arm members adjacent the upper end of the central portion of the main shaft, the arm members of the second set being pivotable between a first position in which the arm members are oriented parallel to and adjacent the main shaft and a second position in which the arm members extend generally transversely to the main shaft.

Preferably there is provided a third set of arm members adjacent the upper end of the upper portion of the main shaft, the arm members of the third set being pivotable between a first position in which the arm members are oriented parallel to and adjacent the main shaft and a second position in which the arm members extend generally transversely to the main shaft.

Arm members of the second set preferably each include a slot extending inwardly from a distal end thereof for receiving a strap of an item of diving gear. The slots are preferably generally parallel to the arm members such that the slots extends horizontally inwardly from the end of the arm members when the arm members are in the second positions.

The arm members of the second set may be provided with serrations on upwardly facing edges. The arm extensions may also be provided with serrations on edges thereof.

Preferably each of the legs comprises an elongate member and includes a foot at a distal end thereof.

BRIEF DESCRIPTION OF THE DRAWINGS

The invention will now be described, by way of example, with reference to the following drawings in which.

DETAILED DESCRIPTION OF THE PREFERRED EMBODIMENTS

Figure 1B:
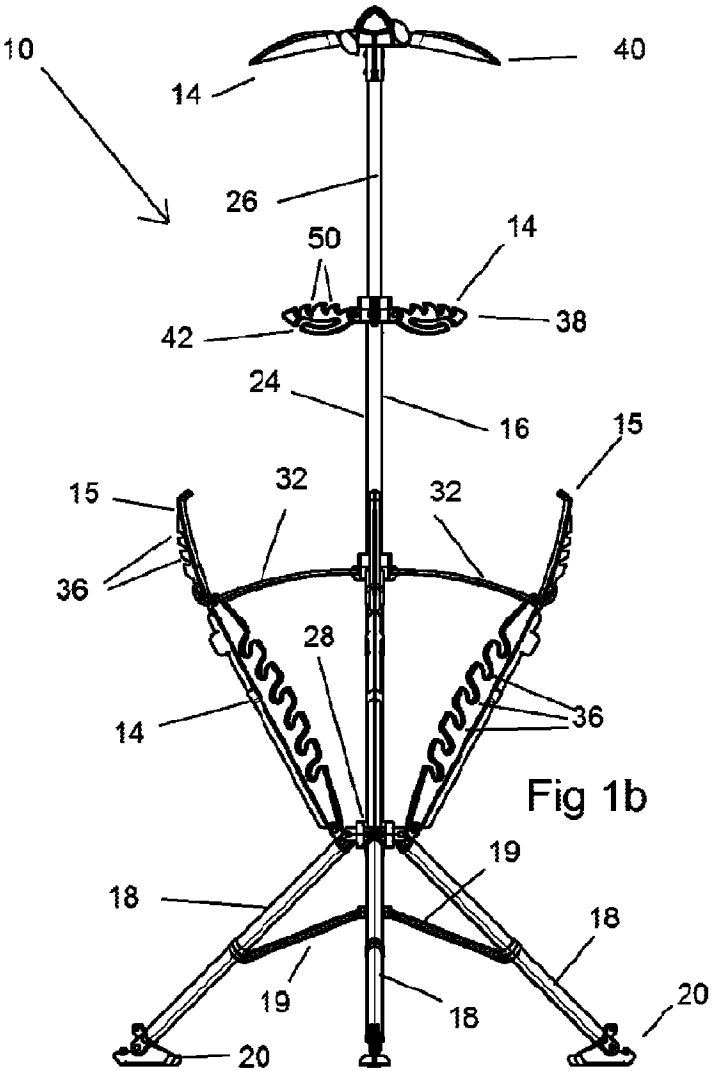
FIG. 1*b* is a side view of the dive gear stand of FIG. 1.

Referring to the Figures, there is shown a dive gear stand 10 comprising a frame 12 and a plurality of arm members 14 on which dive gear can be supported in use.

The frame 12 comprises a main shaft 16 and a plurality of legs 18. The main shaft 16 comprises an elongate member and the legs 18 are pivotally connected at a first end thereof relative to the main shaft 16. In the embodiment shown, there are provided three legs 18. Each of the legs 18 also comprises an elongate member and includes a foot 20 at a second distal end.

Figure 9C:
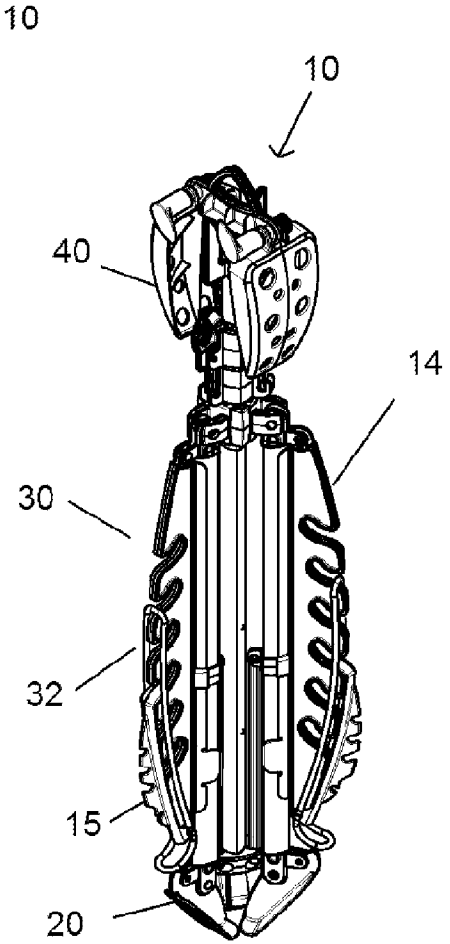
FIG. 9*c* is an upper perspective of the dive gear stand in the fully collapsed configuration.
Figure 9B:
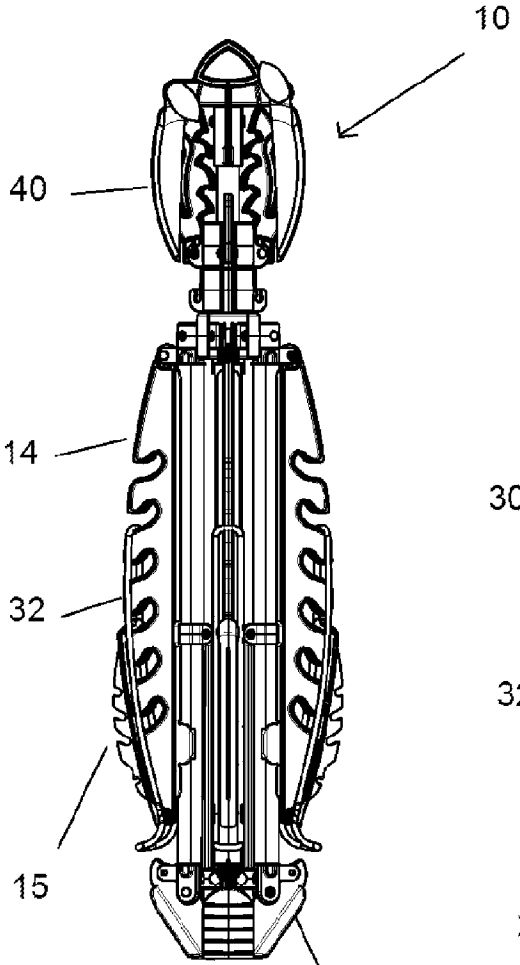
FIG. 9*b* is a side view of the dive gear stand in the fully collapsed configuration.
Figure 9A:
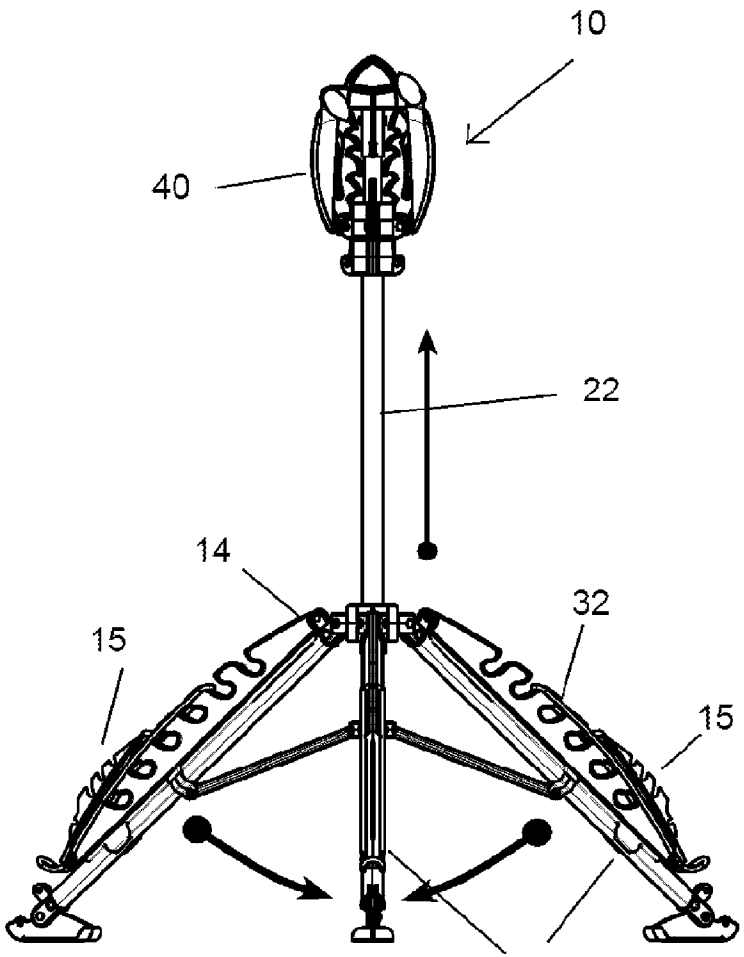
FIG. 9*a* is an upper perspective view of the dive gear stand showing the process of folding the legs and sliding of the first collar up the lower portion of the main shaft.

The legs 18 are pivotally connected to the main shaft 16 at first ends thereof such that the legs 18 can be pivoted between a first position (as shown in FIG. 9) in which the legs 18 are oriented parallel to the main shaft 16 and a second position (as shown in FIGS. 1 to 8) in which the legs 18 extend at an angle outwardly from the main shaft 16. In the second position, the legs 18 form a tripod arrangement from which the main shaft 16 is supported. The main shaft 16 extends vertically upwardly in use from the first ends of the legs 18 in the second position.

The main shaft 16 comprises a lower portion 22, a central portion 24 and an upper portion 26. Each of the lower, central and upper portions 22, 24 and 26 comprises a hollow tube. The central portion 24 is received for sliding motion within the lower portion 22 and the upper portion 26 is received for sliding motion within the central portion 24.

The legs 18 are pivotally connected to the main shaft 16 by a first collar 28 provided on the lower portion 22 of the main shaft 16. The legs 18 are pivotally connected to the first collar 28 and the lower portion 22 of the main shaft 16 can slide within the first collar 28. Each of the legs 18 is provided also with a strut 19 connected from a lower end of the main shaft 16 to a location on the leg 18 between the first and second ends thereof. The struts 19 are pivotally connected to the lower end of the main shaft 16 and the legs 18 such that sliding motion of the of the main shaft 16 up through the first collar 28 causes the legs 18 to move inwardly towards each other.

Figure 1A:
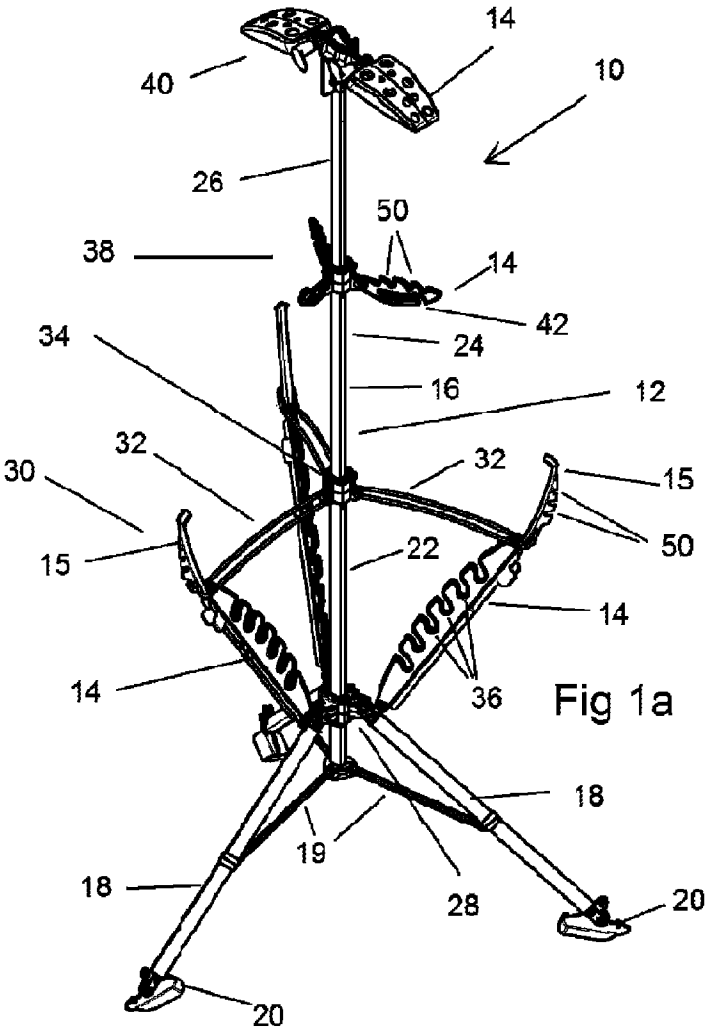
FIG. 1*a* is an upper perspective view of a dive gear stand in its opened configuration for use.

The frame 12 can therefore be collapsed from the in use position (as shown in FIG. 1) by sliding the upper portion 26 of the main shaft 16 into the central portion 24, sliding the central portion 24 into the lower portion 22 and sliding the lower portion 22 down through the first collar 28 until it is located between the legs 18 causing the legs 18 to fold to the first position thereof such that the legs 18 are located adjacent the collapsed main shaft 16.

The arm members 14 are provided in a plurality of sets, each set being located at a different position along the main shaft 16. A first set 30 comprising three arm members 14 at equal angular spacings around the main shaft is provided connected to the first collar 28. Each of the arm members 14 of the first set 30 is pivotally connected at a first end thereof relative to the main shaft 16. The first ends of the arm members 14 are each pivotally connected to the first collar 28 adjacent an associated leg 18. As with the legs 18, the arm members 14 of the first set 30 are pivotable between a first position (as shown in FIG. 9) in which the arm members 14 are oriented parallel to the main shaft 16 and a second position (as shown in FIGS. 1 to 5) in which the arm members 14 extend at an angle outwardly from the main shaft 16. In the second position, the arm members 14 of the first set 30 extend upwardly and away from the first collar 28.

Each of the arm members 14 of the first set 30 is provided with an associated arm support 32. The arm supports 32 are each pivotally connected at a first end thereof to a second end of the associated arm member 14. Each of the arm supports 32 is pivotable between a first position in which it is parallel and adjacent the associated arm member 14 and a second position in which it extends at an angle to the associated arm member 14. As can be seen, each of the arm supports 32 comprises a pair of parallel elongate members joined at ends thereof by an interconnecting portion. When an arm support 32 pivots to the first position thereof, a portion of the arm member 14 is received between the pair of elongate members.

In the second positions thereof, second ends of the arm supports 32 engage with the frame to support the arm members 14 in the second positions. A second collar 34 is provided at an upper end of the lower portion 22 of the main shaft 16 to which second ends of the arm supports 32 can be engaged. The second collar 34 is provided with hooks thereon having upwardly facing openings into which the interconnecting portions of the arm supports 32 can be received.

The arm supports 32 thereby hold the arm members 14 of the first set 30 in the second position such that the arm members 14 extend upwardly and away from the lower end of the main shaft 16. The arm supports 32 extend upwardly from the second ends of the arm members 14 to the second collar 34 as can be seen in FIG. 1.

The arm members 14 of the dive gear stand 10 are provided with features to aid with supporting items of diving gear. The arm members 14 of the first set 30 are each provided with a plurality of notches 36 along a first edge thereof, the first edge being the edge uppermost when the arm member 14 is in the second position. The notches 36 are sized to receive tubing such as the air hoses provided on diving gear so that this gear can be supported by inserting the tubing into one of the notches 36.

The notches 36 each comprise an inner portion 39 being generally circular in shape to receive the tubing and a narrowed neck portion 37 adjacent the first edge of arm member 14. The tubing can therefore be pressed through the narrowed neck 37 portion by slightly compressing the tube and the tubing is then retained in the inner portion 39 of the notch 36. The inner portion 39 is also located lower than the narrowed neck portion 37 so that tubing is received downwardly into the notch 36.

The diving gear stand 10 is also provided with a second set 38 of arm members 14 and a third set 40 of arm members 14. The second set 38 of arm members 14 is provided adjacent the upper end of the central portion 24 of the main shaft 16 and the third set 40 of arm members 14 is provided adjacent the upper end of the upper portion 26 of the main shaft. When the central portion 24 of the main shaft 16 is slid down into the lower portion 22, the second set 38 of arm members 14 is located adjacent the second collar 34. When the upper portion 26 of the main shaft 16 is slid into the central portion 24, the third set 40 of arm members 14 is located adjacent the second set 38 of arm members 14.

The second set 38 of arm members 14 comprises three arm members 14 spaced at equal angular spacings around the main shaft 16. Each of the arm members 14 of the second set 38 is pivotable between a first position in which the arm member 14 is oriented parallel to and adjacent the main shaft 16 and a second position in which the arm member 14 extends generally transversely to the main shaft 16.

The arm members 14 of the second set 38 also include features to aid in retaining items of diving gear. Each of the arm members 14 includes a slot 42 extending inwardly from a distal end. The slots 42 are generally parallel to the arm members 14 such that the slots 42 extend horizontally inwardly from the end of the arm members 14 when the arm members 14 are in the extended positions. The slots 42 may be used for receiving a strap on diving gear such as a diving mask. An inner portion of each the slot 42 is preferably lower than the opening of the slot 42 to aid in retaining the strap in the slot 42. The arm members 14 of the second set may also be provided with serrations 50 on an upwardly facing edge to aid in retaining items supported on the arm members 14.

The third set 40 of arm members 14 comprises a pair arm members 14 on opposite sides of the main shaft 16. Each of the arm members 14 of the third set 40 is pivotable between a first position in which the arm member 14 is oriented parallel to and adjacent the main shaft 16 and a second position in which the arm member 14 extends generally transversely to the main shaft 16.

Figure 6B:
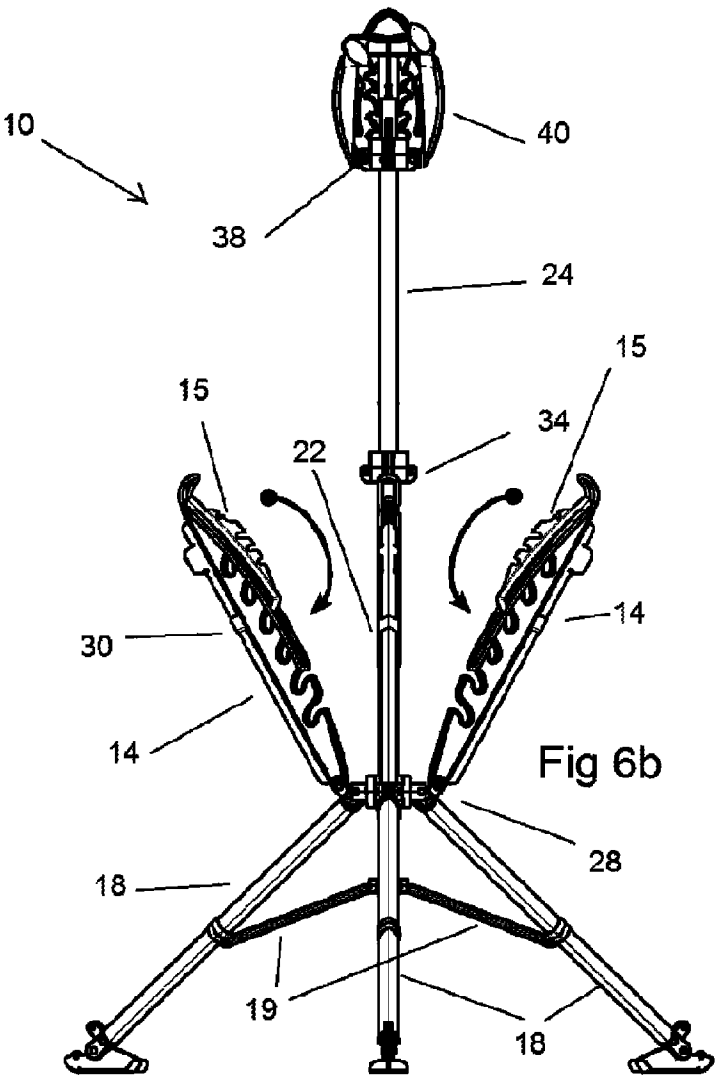
FIG. 6*b* is a side view of the dive gear stand in the configuration of FIG. 6*a;*
Figure 6A:
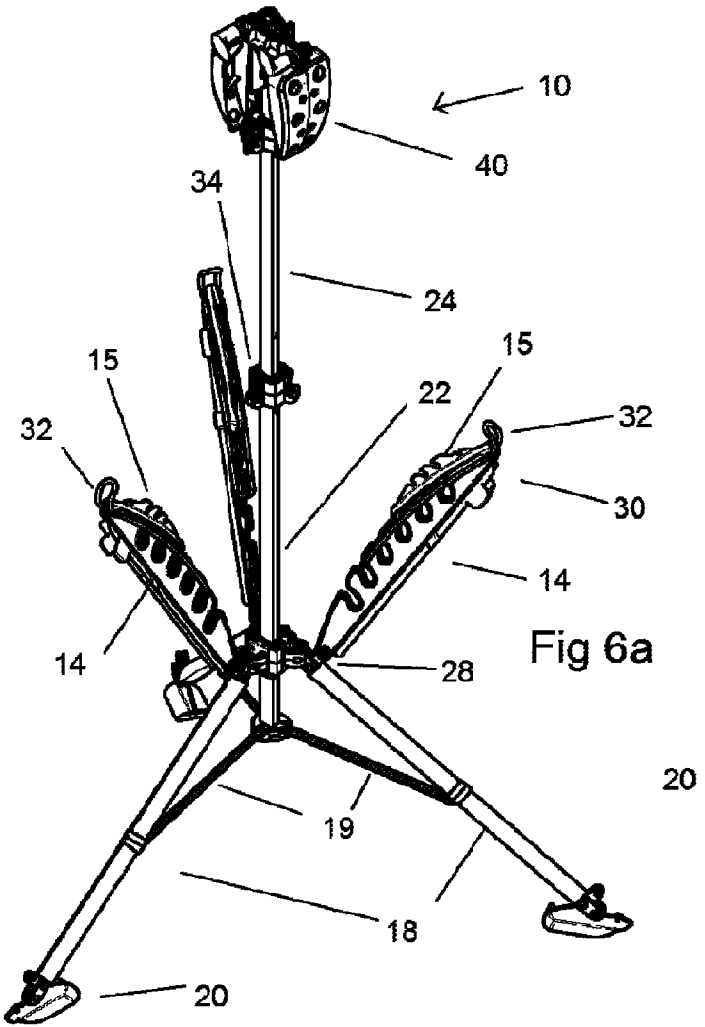
FIG. 6*a* is an upper perspective view of the dive gear stand showing folding of the arm supports against the first set of arms.

The dive gear stand 10 is also provided with arm extensions 15 on each of the arm members 14 of the first set 30. Each of the arm extensions 15 comprises an elongate member pivotally connected to the second end of the arm 14. The arm extensions 15 are each pivotable between an extended position (as shown in FIG. 1) in which the arm extension 15 extends generally away from the second end of the arm member 14 to a collapsed position (as shown in FIG. 6) in which the arm extension 15 is folded back against the arm member 14. The arm extensions 15 in the extended configuration may be used to support further items of dive gear. The arm extensions 15 may also be provided with serrations 50 on edges thereof.

Figure 5B:
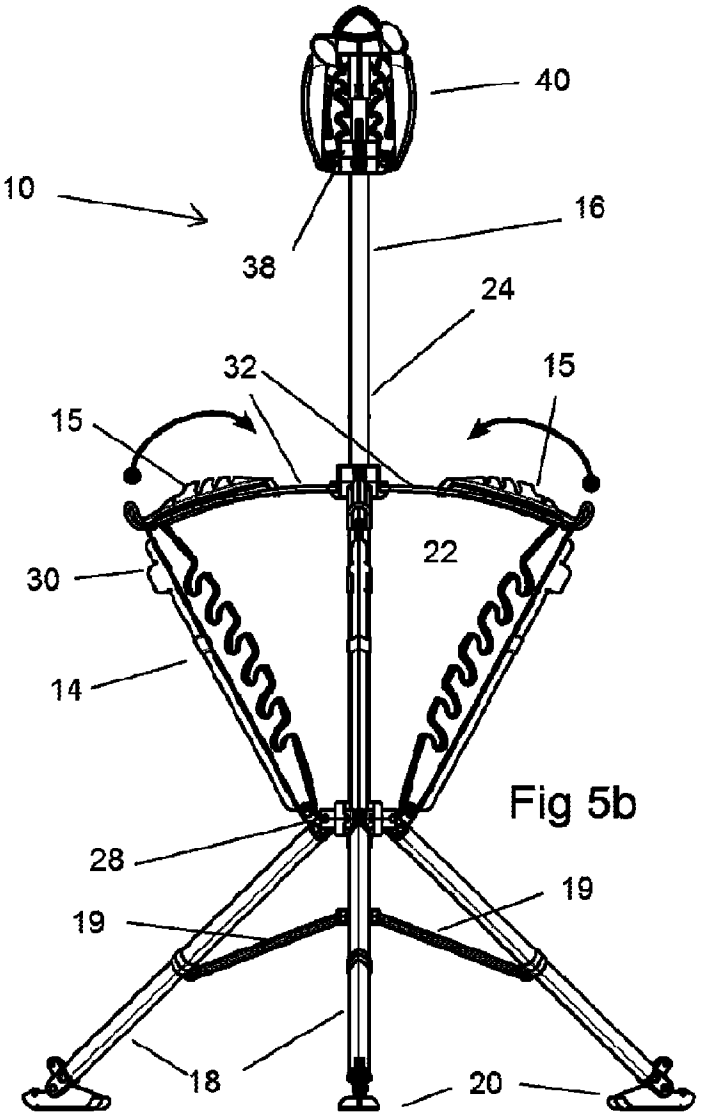
FIG. 5*b* is a side view of the dive gear stand in the configuration of FIG. 5*a;*
Figure 5A:
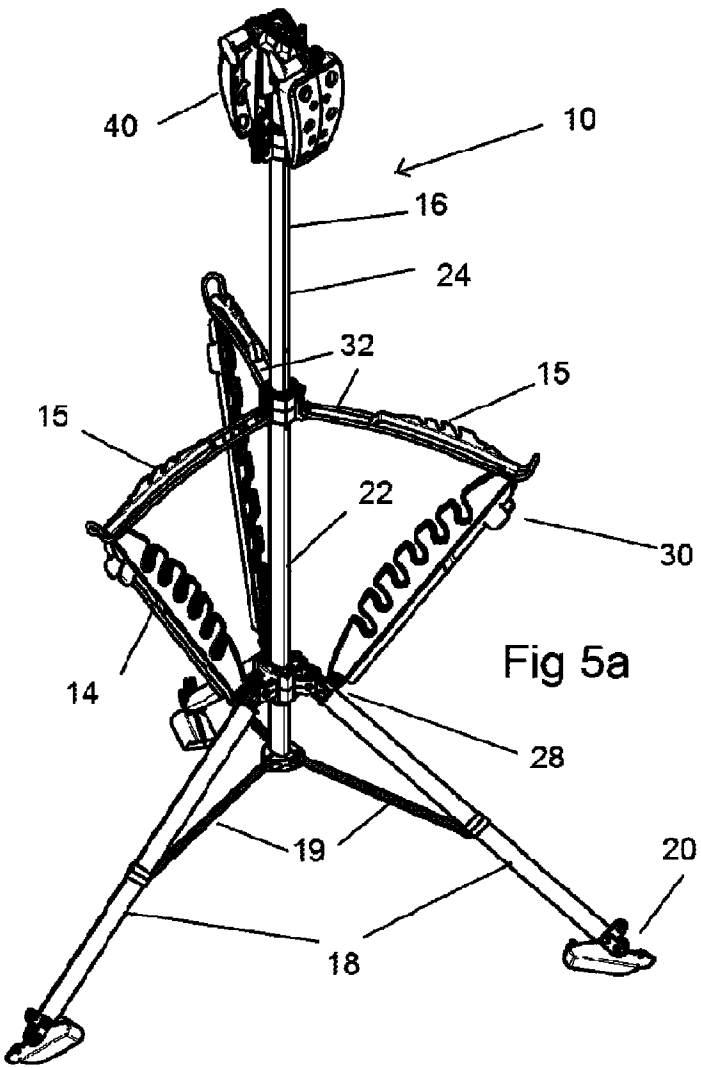
FIG. 5*a* is an upper perspective view of the dive gear stand showing the folding of arm extensions provided on the first set of arms.

As shown in FIGS. 5 and 6, each arm extension 15 is first pivoted downwardly against the associated arm support 32 and the arm support 32 and arm extension 15 are then folded back against the arm member 14 in the process of collapsing the dive gear stand 10.

In use, the dive gear stand 10 can be set up for example on the beach as shown in FIG. 1. The arm members 14 of the second and third sets 38 and 40 can be used for supporting dive gear such as masks or fins when the diver leaves the water to allow it to dry. Gear such as vests can be placed over the arm members 14 of the first set 30 by receiving a pair of adjacent arm members 14 within the shoulder portions of the vest. Further, any gear having tubing, such as regulators, can be supported from the arm members 14 of the first set 30 by placing portions of the tubing in the notches 36 in the arm members 14.

Figure 2B:
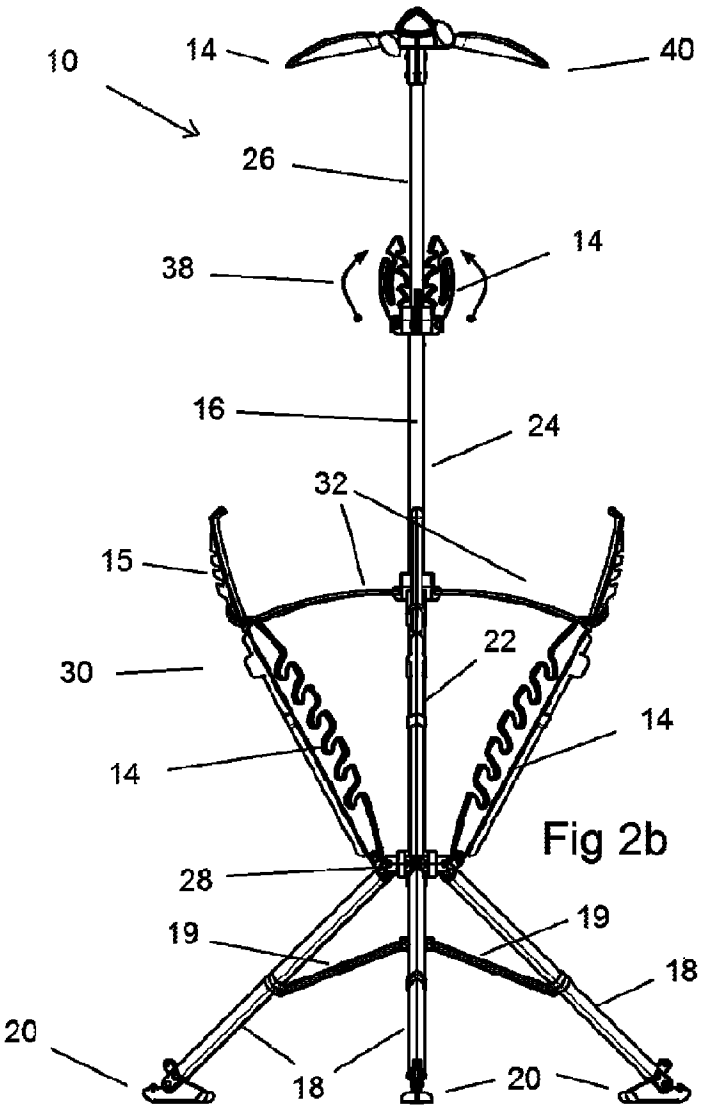
FIG. 2*b* is a side view of the dive gear stand in the configuration of FIG. 2*a;*
Figure 2A:
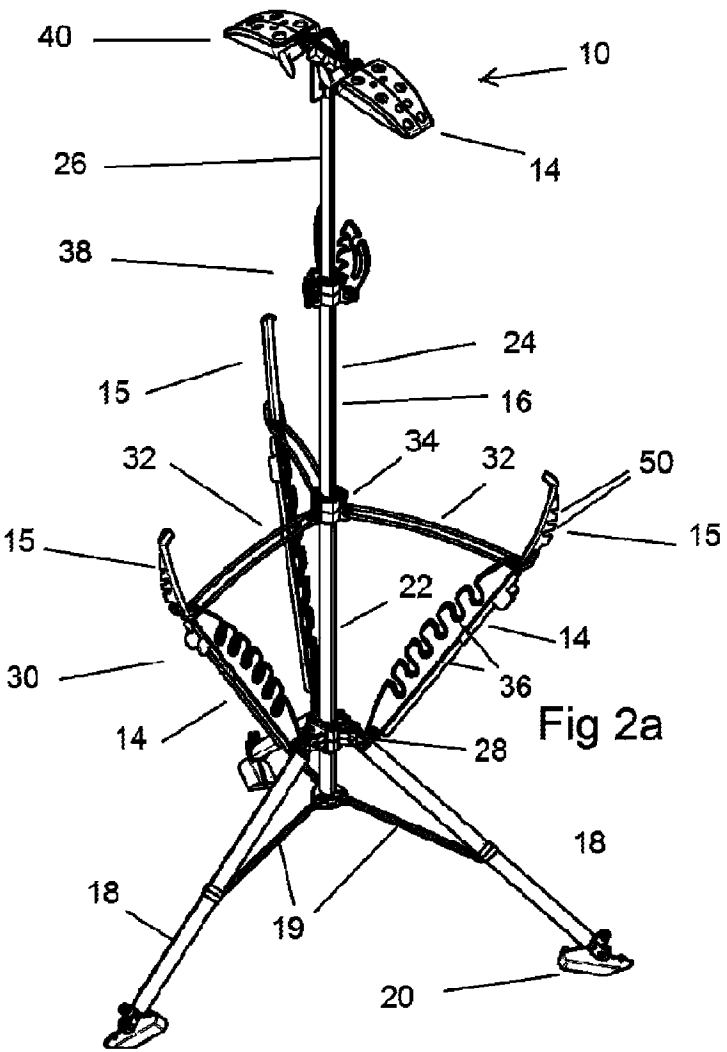
FIG. 2*a* is an upper perspective view of the dive gear stand of FIG. 1 with arms on the central portion of the main shaft retracted.
Figure 3B:
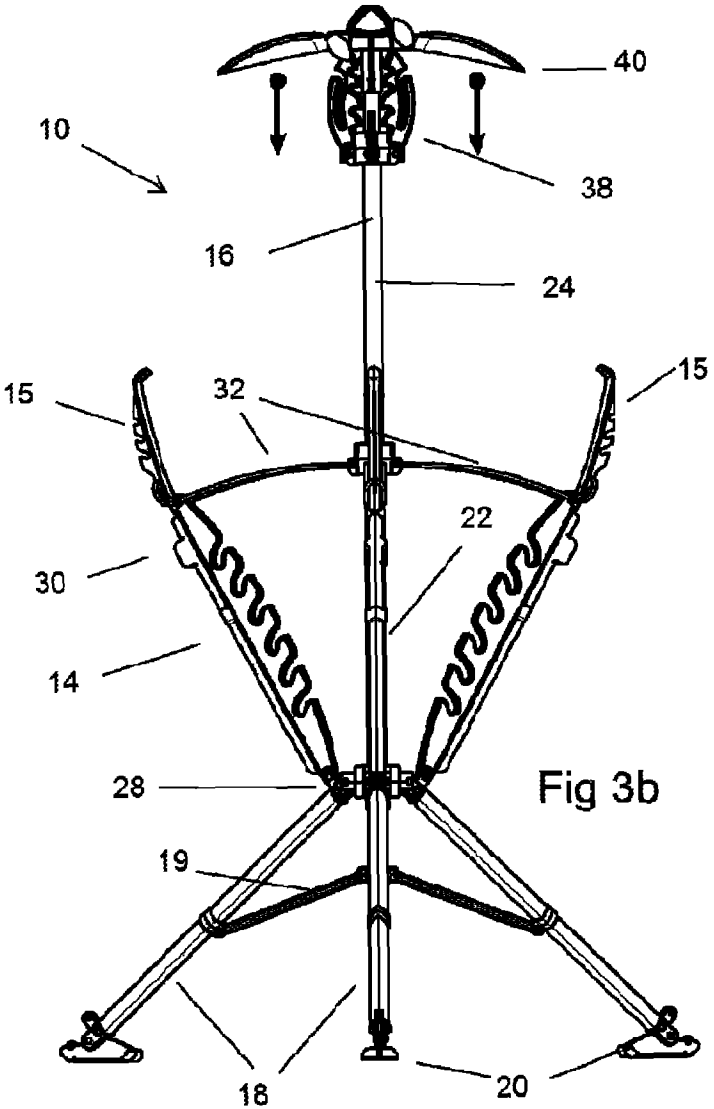
FIG. 3*b* is a side view of the dive gear stand in the configuration of FIG. 3*a;*
Figure 3A:
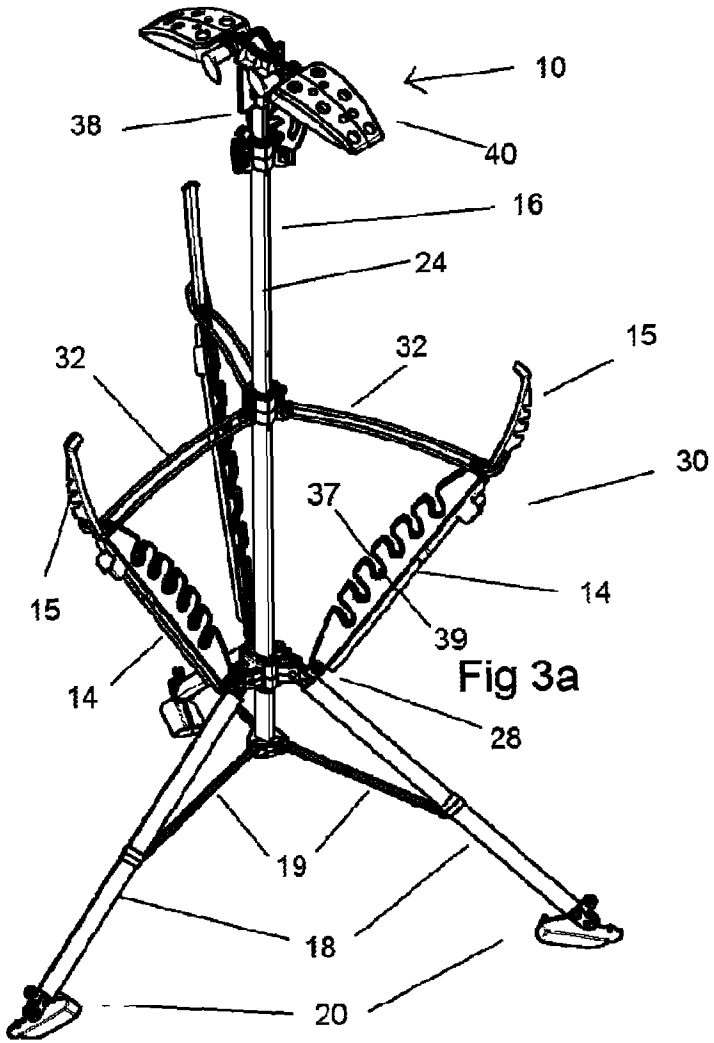
FIG. 3*a* is an upper perspective view of the dive gear stand with the upper portion of the main shaft retracted into the central portion.
Figure 4B:
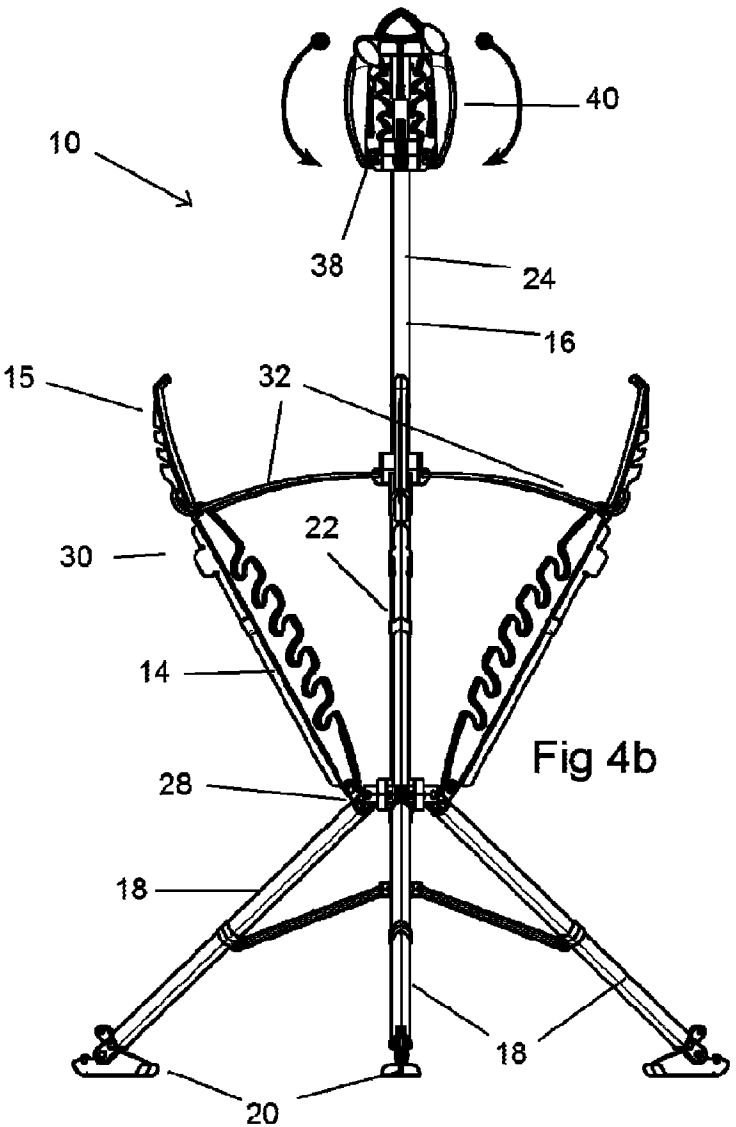
FIG. 4*b* is a side view of the dive gear stand in the configuration of FIG. 4*a;*
Figure 4A:
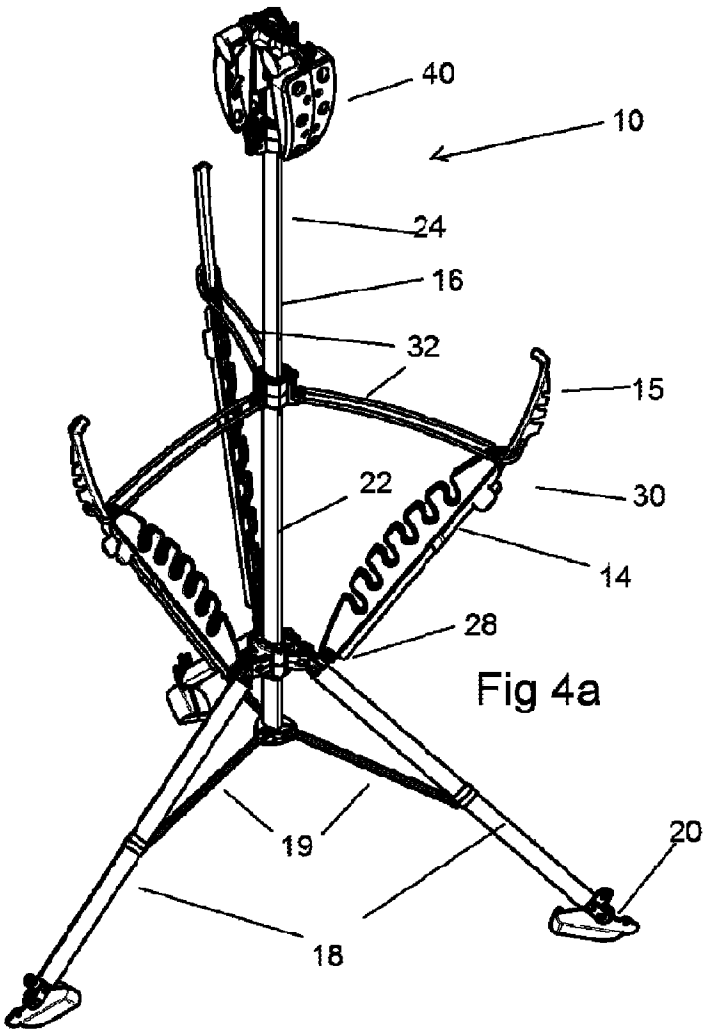
FIG. 4*a* is an upper perspective view of the dive gear stand of FIG. 1 with the arms on the upper portion of the main shaft retracted.
Figure 7B:
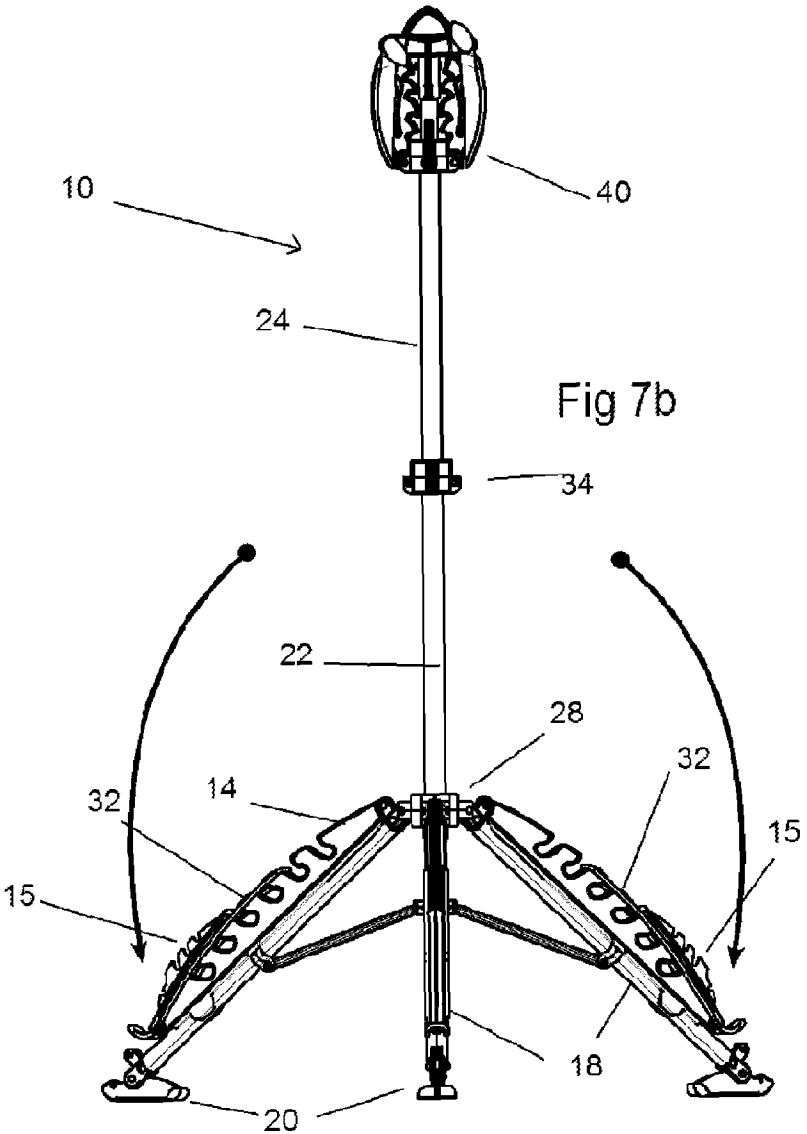
FIG. 7*b* is a side view of the dive gear stand in the configuration of FIG. 7*a;*
Figure 7A:
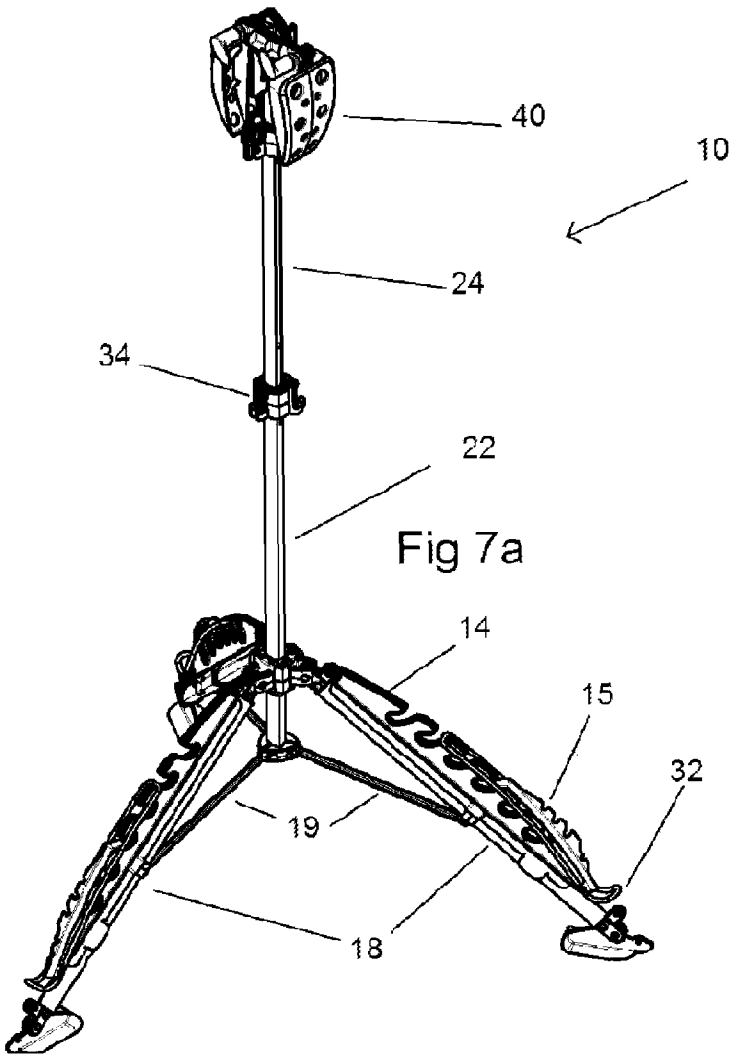
FIG. 7*a* is an upper perspective view of the dive gear stand showing the first set of arms folded against the legs.
Figure 8B:
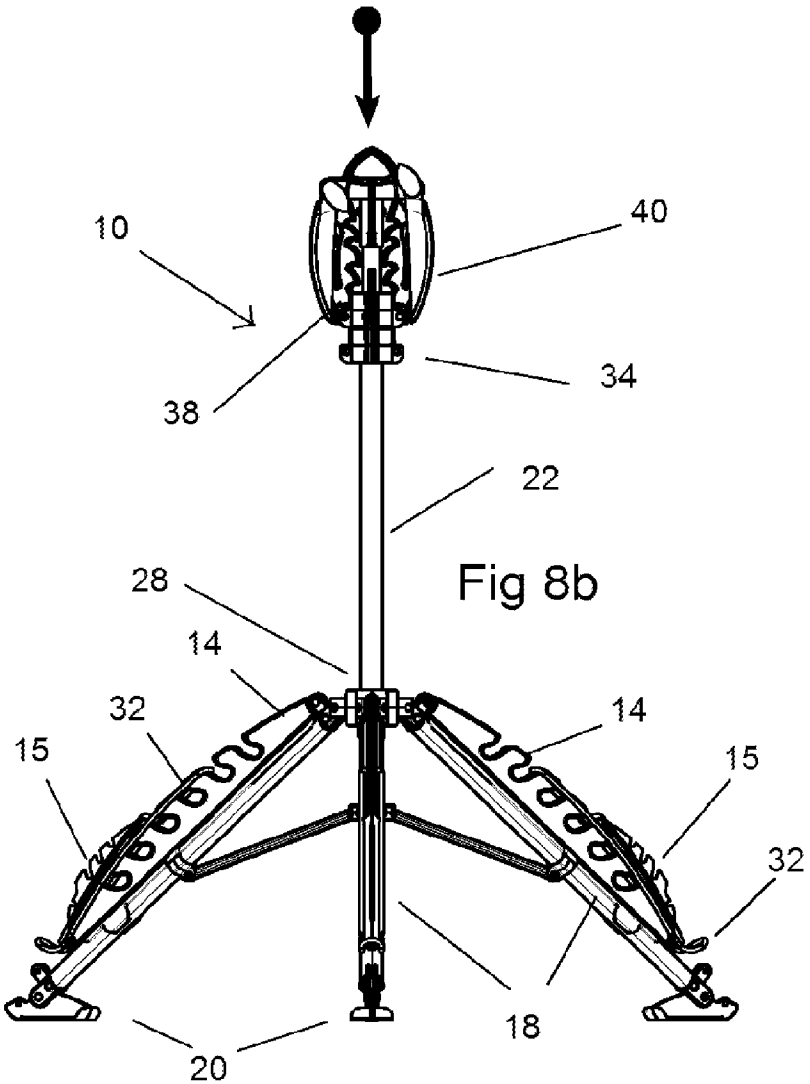
FIG. 8*b* is a side view of the dive gear stand of FIG. 8.
Figure 8A:
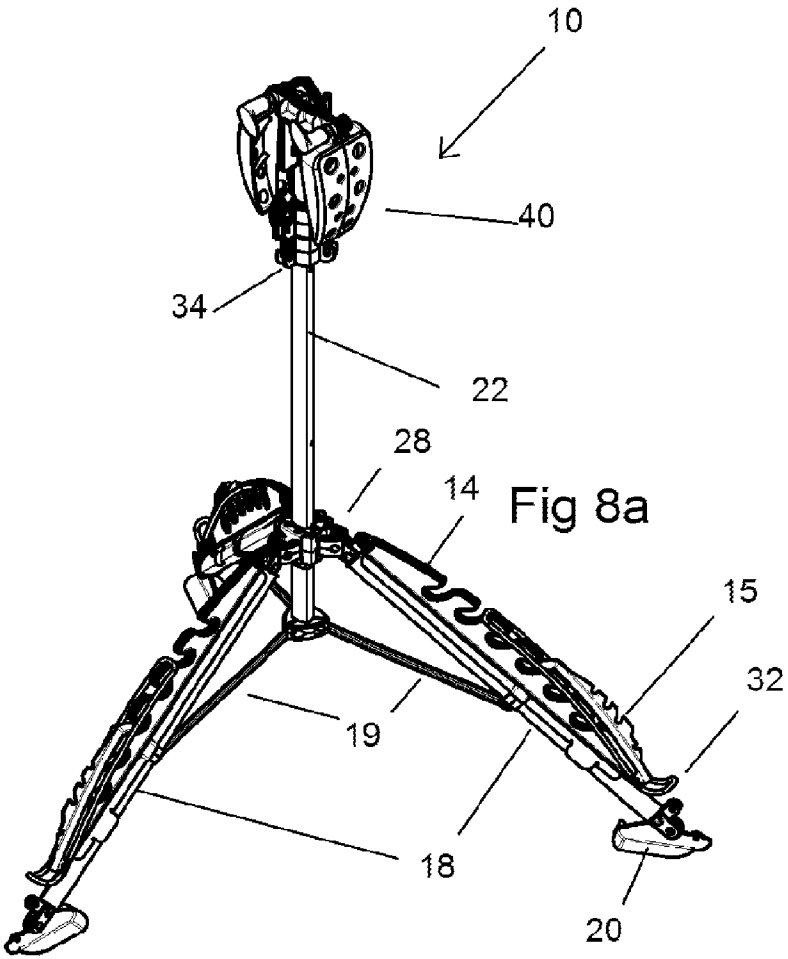
FIG. 8*a* is an upper perspective view of the dive gear stand showing the central portion of the main shaft retracted into the lower portion.

When it is desired to pack up the dive gear stand 10, the arm members 14 of the second and third sets 38 and 40 can be pivoted to the first positions thereof and the upper and central portions 24 and 26 of the main shaft 16 slid into the lower portion 22 as shown in FIGS. 2 to 4. The arm supports 32 are then disconnected from the second collar 38 and pivoted to the first positions thereof against the arm members 14 of the first set 30 and the arm members 14 pivoted downwardly adjacent the legs 18 (as shown in FIG. 7). The legs 18 are then pivoted to the first positions thereof and the main shaft 16 slid downwardly between the legs 18 (as shown in FIG. 9). The process for setting up the dive gear stand 10 from the collapsed position is the reverse of the process for collapsing.

It will be readily apparent to persons skilled in the relevant arts that various modifications and improvements may be made to the foregoing embodiments, in addition to those already described, without departing from the basic inventive concepts of the present invention.

What is claimed is:

1. A dive gear stand comprising:

a frame including a main shaft;

a first collar slidably mounted on the main shaft;

a plurality of legs supporting the first shaft vertically and pivotally connected to the first collar at first ends thereof such that the legs can be pivoted between a first position in which the legs are oriented parallel to the main shaft and a second position in which the legs extend at an angle outwardly from the main shaft;

a first set of arm members each pivotally connected at a first end thereof to the first collar; and a set of arm supports each pivotally connected at a first end thereof to a second end of an associated arm member of the first set;

wherein each of the arm members of the first set is pivotable between a first position in which the arm member is oriented parallel to the main shaft and a second position in which the arm member extends upwardly and away from the main shaft; and wherein each of the arm supports is pivotable between a first position in which it is parallel and adjacent the associated arm member and a second position in which it extends at an angle to the associated arm member such that a second end thereof is releasably engageable with the frame at a location above the first ends of the arm members to support the arm member in the second position.

2. The dive gear stand in accordance with claim 1, wherein each of the arm members of the first set is pivotable to a position in which it is parallel and adjacent one of the legs.

3. The dive gear stand in accordance with claim 1, wherein struts are connected from a lower end of the main shaft to a location on each of the legs between the first and second ends such that sliding motion of the main shaft up through the first collar causes the legs to move inwardly towards each other.

4. The dive gear stand in accordance with claim 1, wherein each of the arm members of the first set is provided with a plurality of notches along an upper edge thereof, each notch being provided to receive tubing of diving gear.

5. The dive gear stand in accordance with claim 4, wherein each of the notches comprises an inner portion being generally circular in shape to receive the tubing and a narrowed neck portion adjacent the first edge of the arm member.

6. The dive gear stand in accordance with claim 1, wherein each of the arm supports comprises a pair of parallel elongate members joined at ends thereof by an interconnecting portion such that when an arm support pivots to the first position thereof, a portion of the arm member is received between the pair of elongate members.

7. The dive gear stand in accordance with claim 6, wherein a second collar is provided on the main shaft, the second collar having hooks thereon with upwardly facing openings into which the interconnecting portions of the arm supports are received.

8. The dive gear stand in accordance with claim 1, wherein the first set of arm members comprises three arm members at equal angular spacings around the main shaft and three legs are provided each adjacent one of the arm members.

9. The dive gear stand in accordance with claim 1, wherein each of the arm members of the first set is provided with an arm extension, each arm extension being pivotally connected to the second end of the arm member such that the arm extension is pivotable between an extended position in which the arm extension extends generally away from the second end of the arm member to a collapsed position in which the arm extension is folded back against the arm member.

10. The dive gear stand in accordance with claim 1, wherein the main shaft comprises a lower portion, a central portion and an upper portion wherein the central portion is received for sliding motion within the lower portion and the upper portion is received for sliding motion within the central portion.

11. The dive gear stand in accordance with claim 10, wherein there is provided a second set of arm members adjacent the upper end of the central portion of the main shaft, the arm members of the second set being pivotable between a first position in which the arm members are oriented parallel to and adjacent the main shaft and a second position in which the arm members extend generally transversely to the main shaft.

12. The dive gear stand in accordance with claim 11, wherein there is provided a third set of arm members adjacent the upper end of the upper portion of the main shaft, the arm members of the third set being pivotable between a first position in which the arm members are oriented parallel to and adjacent the main shaft and a second position in which the arm members extend generally transversely to the main shaft.

13. The dive gear stand in accordance with claim 11, wherein arm members of the second set each include a slot extending inwardly from a distal end thereof for receiving a strap of an item of diving gear.

14. The dive gear stand in accordance with claim 13, wherein the slots are generally parallel to the arm members of the second set such that the slots extends horizontally inwardly from the end of the arm members of the second set when the arm members of the second set are in the second positions.

15. The dive gear stand in accordance with claim 11, wherein the arm members of the second set are provided with serrations on upwardly facing edges.

16. The dive gear stand in accordance with claim 9, wherein the arm extensions are provided with serrations on edges thereof.

17. The dive gear stand in accordance with claim 1, wherein each of the legs comprises an elongate member and includes a foot at a distal end thereof.

* * * * *